United States Patent [19]

Nakano

[11] 4,393,287

[45] Jul. 12, 1983

[54] ARC SUPPRESSING MEANS FOR CURRENT LIMITING CIRCUIT BREAKERS

[75] Inventor: Kunimitsu Nakano, Osaka, Japan

[73] Assignee: Matsushita Electric Works, Ltd., Osaka, Japan

[21] Appl. No.: 185,802

[22] Filed: Sep. 10, 1980

[30] Foreign Application Priority Data

Sep. 14, 1979 [JP] Japan ..... 54-129722[U]

[51] Int. Cl.[3] ..... H01H 33/08; H01H 9/34

[52] U.S. Cl. ..... 200/144 R; 200/147 R

[58] Field of Search ..... 200/144 R

[56] References Cited

U.S. PATENT DOCUMENTS 3,270,170 8/1966 Fehrenbach et al. ..... 200/144 R
3,564,176 2/1971 Fechant ..... 200/144 R

FOREIGN PATENT DOCUMENTS 1219578 6/1966 Fed. Rep. of Germany ... 200/144 R
1415944 2/1969 Fed. Rep. of Germany ... 200/144 R
1926693 11/1970 Fed. Rep. of Germany ... 200/147 R
1765051 7/1971 Fed. Rep. of Germany ... 200/144 R
732196 6/1955 United Kingdom ..... 200/147 B
775895 5/1957 United Kingdom ..... 200/144 R

*Primary Examiner*—Robert S. Macon
*Attorney, Agent, or Firm*—Burns, Doane, Swecker & Mathis

[57] ABSTRACT

Arc suppressing means for current limiting circuit breakers wherein an arc generated between both movable and fixed contacts by an excess current at the time of short-circuiting is magnetically driven by a member extending from the contact part of fixed contactor to an arc running plate in the right angle relation to the plate with a shortened time of arc's staying at the contact part and a shortened time of arc's traveling from the member to a deion grid along the running plate to quickly obtain an elevated arc voltage and to thereby effectively elevate current limiting effect.

10 Claims, 9 Drawing Figures

ARC SUPPRESSING MEANS FOR CURRENT LIMITING CIRCUIT BREAKERS

This invention relates generally to arc suppressing means for current limiting circuit breakers and, more particularly, to improvements in the means for magnetically driving an arc produced between fixed and movable contacts at a breaking operation of the circuit breaker into a deion grid and suppressing the arc by limiting the short-circuiting current flowing between the both contacts.

In the circuit breaker of the kind referred to, generally, there are provided between each pair of a current source side terminal connecting a fixed contactor to respective pole terminals of a single-phase, three-phase or the like alternating current source and a load side terminal connecting a movable contactor movable between both positions of contacting with and separating from the fixed contactor to a load circuit, a mechanical contact operating mechanism for moving the movable contactor by a manual operation between the both positions and an electric tripping mechanism inserted in an electric current path between the movable contactor and the load side terminal for separating the movable contactor from the fixed contactor by forcibly tripping the closed state of the contact operating mechanism holding the movable contactor in the position of contact with the fixed contactor, in response to an excess current due to a short-circuiting accident or the like occurring in the load circuit. Further, an arc suppressing means is arranged adjacent fixed and movable contacts of the both contactors in order to prevent the both contact operating and tripping mechanisms from being damaged by the arc produced between the both contacts when the movable contactor is forcibly separated from the fixed contactor.

Particularly, the excess short-circuiting current flowing between the both contacts at such forcible tripping operation will last for a period substantially equal to the half cycle of the alternating current source current usually as shown by a chain line SCC in FIG. 1A, whereas the arc will be generated normally a little later than the rise of the short-circuiting current SCC for a so-called opening time required for separating the movable contact from the fixed contact as shown by an arc voltage curve NVa in FIG. 1B and thus generated arc will gradually increase to reach the peak adjacent the zero point of the short-circuiting current and to quickly vanish thereafter. In such case, the arc will be continuously generated while gradually expanding substantially between the both contacts separated from each other so that influences of the arc on the both contacts and the respective mechanisms connected to the movable contactor will be large.

In the arc suppressing means employing conventionally an arc dividing or deion grid, the fact that, in case the movable and fixed contactors are extended in the same direction as opposed to each other, the directions of the excess current flowing within the respective contactors from one to the other will be reverse and such reverse directional currents generate a magnetic field between the both contactors the force of which acting in endwise direction of the respective contactors is utilized, whereby the arc generated between the both contacts is driven to be drawn as divided into respective gaps between respective metal plates forming the grid at a position in the direction of the magnetic force and arranged to be of the same potential as the fixed and movable contactors at the both outermost side metal plates. The total voltage of the thus divided arcs within the grid will be made higher generally in accordance with the number of the metal plates. In this arrangement, the forcible tripping mechanism functions to render the opening time of the contacts as short as possible by such means as an electromagnetic device for attracting a plunger engaged to the movable contactor in the direction of separating the contactor from the fixed contactor as operated by the excess current in addition to a bimetal element operating to release the closed state of the contact operating mechanism also responsive to the excess short-circuiting current.

The arc generated after the thus shortened opening time A (FIG. 1B) will be magnetically driven in the direction toward the grid by the arc suppressing means but will still stay substantially between the both contacts during an arc staying time B following the opening time. However, the arc will gradually become larger and expand toward the entire opposing end surface of the grid within a subsequent comparatively short arc traveling time C, after which the expanded arc reaches the end surface of the grid. The arc voltage at this time will reach a higher peak value within a far shorter time than that of a normal arc voltage NVa in the case where no arc suppressing means is employed, as shown by a dotted line Va1 in FIG. 1B. After this time point, the arc runs as divided into small arcs in the respective gaps of the grid, while maintaining the peak voltage value, towards the other end surface of the grid where the respective arcs are extinguished. The short-circuiting current in such case is caused to be subjected to the so-called current limiting effect according to which the current gradually decreases after the arc voltage Va1 reaches the peak and becomes zero early as shown by a dotted line LSCC in FIG. 1A, whereby the arc is caused to vanish simultaneously with the current.

According to the arc suppressing means of the kind referred to, therefore, the arc voltage can be made to reach the peak before the short-circuiting current reaches its peak, whereby the short-circuiting current can be made to each the zero point at a time earlier than in ordinary cases and the arc can be well suppressed. In other words, the characteristics of the arc suppressing means depend on the current limiting effect, that is, how early the peak of the arc voltage can be reached. Accordingly, the arc suppressing performance is to be determined by how much the staying time B and traveling time C of the generated arc can be shortened. The short-circuiting current SCC in the ordinary case will show the peak value generally in about 4 m.sec. and will reach the zero point in about 10 m.sec. However, in the case that the arc is magnetically driven into the gaps of such grid as described above to be thereby suppressed, the arc voltage is elevated by properly selecting the number of the metal plates forming the grid in response to improvements in the magnetic driving capacity, so that the peak of the arc voltage Va1 can be obtained in a time of about 1.5 m.sec. which is earlier than the peak time of the short-circuiting current, that is, after about 0.5 m.sec. from the above described opening time of about 1 m.sec., a limited short-circuiting current reaching the zero point in a time of about 6 m.sec. as shown by a dotted line LSCC in FIG. 1A by the decrease of the current after the arc voltage peak can be obtained and the arc can be simultaneously suppressed. It should be noted here that even a slight shortening by about 0.1 to 0.2 m.sec. of the arc staying and traveling time normally requiring about 0.5 m.sec. will result in a remarkable improvement as will be clear from that the current limiting effect can be represented by the area defined by the limited short-circuiting current curve and the abscissa in FIG. 1A. On the other hand, the maximum value to which the arc voltage can be elevated by the grid will be substantially limited by such various conditions as the current source, load circuit and breaker adapted to them and, therefore, the possible shortening of the arc staying and traveling time will depend mostly on the magnetic driving capacity of the arc suppressing means which biases the generated arc away from the both contacts, further causes it to expand and quickly draw it into the grid. This capacity particularly in expanding and drawing the arc will be influenced by the degree of the effect of ions of evaporated gas from the contact material, as being an arc generating condition in the atmosphere, in addition to the strength of the magnetic flux due to the short-circuiting current and, even if a sufficient driving capacity is well obtained, it becomes impossible to maintain the high arc voltage which attains the current limiting effect of causing the short-circuiting current to reach the zero point positively earlier, unless the divided arcs effectively drawn into the respective gaps within the grid are respectively positively extinguished without being bridged again with each other at the terminating end in the longitudinal direction of the grid and only resultant gas cooled while passing through the grid is exhausted in the endwise direction of the grid. Therefore, the performance of the arc suppressing means is to be determined by the general design conditions of the respective components.

A primary object of the present invention is, therefore, to provide an arc suppressing means for circuit breakers showing a high current limiting effect.

Another related object of the present invention is to provide an arc suppressing means for current limiting circuit breakers embodying optimum conditions for magnetically driving and suppressing generated arc.

A further related object of the present invention is to provide an arc suppressing means for current limiting circit breakers which can optimumly magnetically drive generated arc and positively divide and extinguish it in the deion grid.

Other objects and advantages of the present invention shall be made clear as the following explanation of the invention advances while being detailed with reference to preferred embodiments shown in accompanying drawings, in which.

Figure 7:
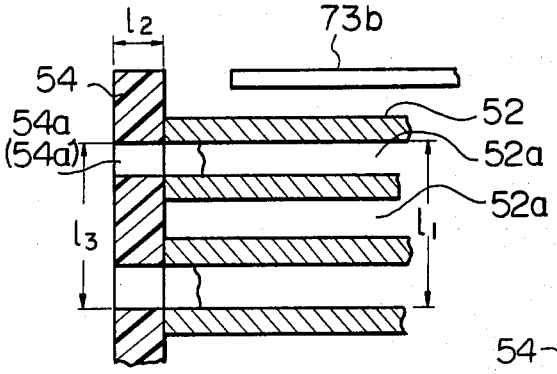
Figure 8:
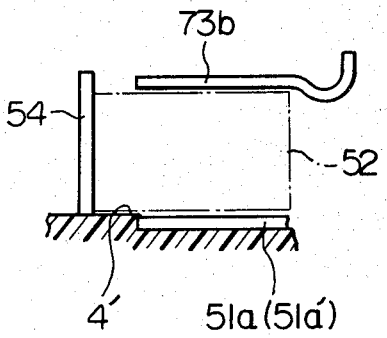

FIG. 7 is a fragmentary sectioned view as magnified for showing an arrangement in an embodiment of a gas exhaust plate at the terminating end of a deion grid of the arc suppressing means according to the present invention; and FIG. 8 is a fragmentary sectioned view showing an embodiment specifically in the arrangement of the arc running plate on the side of fixed contactor in relation to the bottom surface of an arc suppressing chamber of the arc suppressing means according to the present invention.

While the present invention shall now be described in detail with reference to the illustrated embodiments, the intention is not to limit the invention to the particular embodiments but rather to include all alterations, modifications and equivalent arrangements possible within the scope of appended claims.

Figure 2:
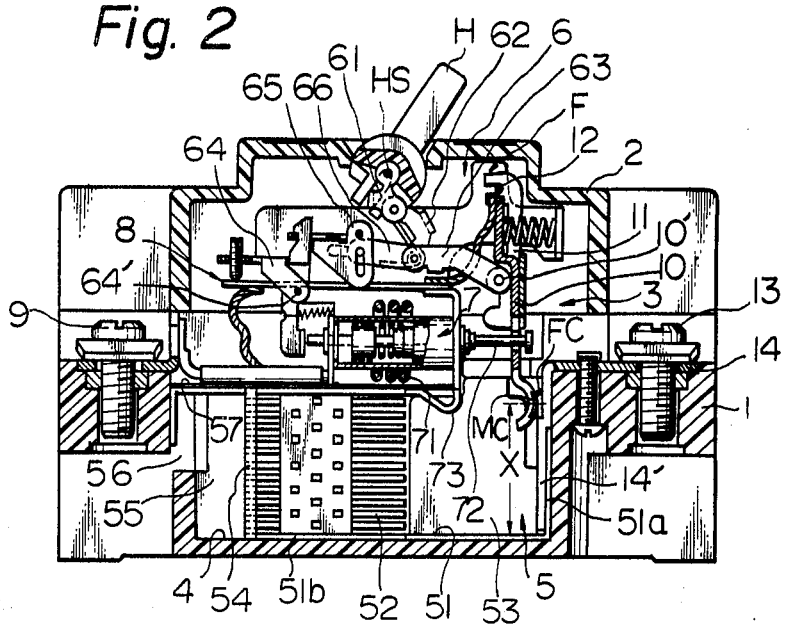
FIG. 2 is a vertically sectioned view showing a general arrangement of the current limiting circuit breaker provided with an arc suppressing means according to an embodiment of the present invention.
Figure 3:
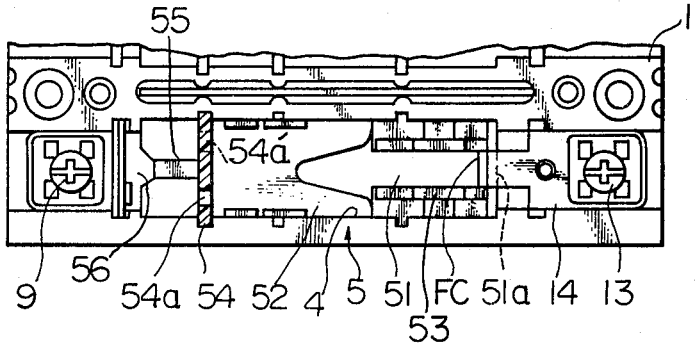
FIG. 3 is a fragmental plan view showing the arc suppressing means at a single pole part of the breaker shown in FIG. 2 with a part in section and with contact operating and tripping mechanisms connected to a movable contactor in the breaker as well as the cover removed.

Referring now generally to the entire arrangement of the current limiting circuit breaker provided with the arc suppressing means according to an embodiment of the present invention with reference to FIGS. 2 and 3, the breaker comprises a case consisting of a base 1 and a cover 2 respectively made of an electrically insulative material, a main breaker part 3 housed mostly within the cover 2 and manually operated through a handle H projecting out of the cover, and an arc suppressing means 5 housed within an arc suppressing chamber 4 of an elongated groove shape in the present instance formed within the base 1 so as to open on the side on which the main part 3 is positioned within the cover 2. The main breaker part 3 and arc suppressing means 5 form each of a plurality of sets corresponding in number to a required number of poles depending on the type of a source current, and the respective sets are provided in each arc suppressing chamber 4 of the base 1 as mutually insulated and separated.

The main breaker part 3 comprises a mechanical contact operating mechanism 6 with which the handle H is operatively engaged, a tripping mechanism 7 which forcibly releases a contact closing state of the operating mechanism 6 responsive electromagnetically to the excess short-circuiting current from the load circuit and a bimetal means 8 which is interposed between the both mechanisms 6 and 7 and releases also the contact closing state of the mechanism 6 responsive thermally to the excess short-circuiting current. The mechanisms 6 and 7 are supported between a pair of parallel plates forming a frame F which is fixed to the base 1 so as to be positioned above the arc suppressing chamber 4 by a proper means. A load side connecting terminal 9 is fitted to the base 1 on one longitudinal end side of the arc suppressing chamber 4 and a movable contactor 10 having a movable contact MC at one end is electrically connected at the other end to the terminal 9 through an electromagnetic coil 71 of the tripping mechanism 7 and the bimetal means 8. The movable contactor 10 is joined to a contact opening and closing arm 11 extending in the longitudinal direction of the contactor 10, whereas the arm 11 is pivoted on the other end side of the movable contactor 10 to a shaft 12 fixed to the frame F so that the movable contact MC of the movable contactor 10 will be suspended rotatably about the shaft 12. A current source side terminal 13 fitted to the other longitudinal end side of the arc suppressing chamber 4 is connected to one leg fastened to the base 1 of a fixed contactor 14 which is bent to be substantially L-shaped and the other leg of the contactor 14 having a fixed contact FC is disposed within the chamber 4 so as to oppose the fixed contact FC to the movable contact MC of the movable contactor 10.

The mechanical contact operating mechanism 6 is not directly related to the subject of the present invention and shall not be described in detail here but, briefly stating, it comprises a first link system consisting of a handle link 61, turning link 62 and main link 63 which are linking between a handle shaft HS fixed to the frame F and a connecting shaft 10' provided in a position separated from the pivoting end of the contact opening and closing arm 11, and a second link system consisting of a ratch link 65 and tripping link 66 linking between a tripping lever 64 rockably privoted to the frame on the side opposite to the connecting shaft 10' of the arm 11 in the lengthwise direction of the frame F and a link shaft between the links 62 and 63 of the first system. FIG. 2 shows a circuit closed state in which the operating mechanism 6 holds the movable contact MC in contact with the fixed contact FC, the handle H rotated to the ON-position keeps the first link system in the closed state against the force of a spring normally separating the movable contactor 10 from the fixed contact FC and, in the second link system, the ratch link 65 is engaged with a hook end of the tripping lever 64 in response to this state of the first link system and is locked in the ratch position, whereby the main link 63 is locked in the closed state through the tripping link 66. The tripping lever 64 is provided with an end for engaging with the tripping mechanism 7 and extending substantially on the opposite side to the hook end with respect to the pivoting shaft 64' and with an arm extending substantially at right angles with respect to extending directions of both the hook and engaging ends, which arm is opposed to the free end of the bimetal means 8 fixed at one end to a base plate of the tripping mechanism 7. The tripping mechanism 7 fixed to the frame F through the base plate comprises an electromagnetic coil 71 and a plunger 72 disposed within the coil and passed through the movable contactor 10 at one end having a flange. The plunger is normally biased by a spring into a position allowing the movable contactor 10 to rotate into the closed state wherein the movable contact MC is contacted with the fixed contact FC, and this plunger 72 is opposed at the other end to the engaging end of the tripping lever 64. The tripping lever 64 is normally biased by a spring so as to engage at the hook end with the ratch link 65 and at the engaging end with the other end of the plunger 72 in its normal spring biased position.

When, in the closed state of the main part 3 of the breaker, the excess short-circuiting current flows from the load side terminal 9 to the electromagnetic coil 71 and bimetal means 8, the plunger 72 will be attracted in the axial direction by a magnetic field produced within the electromagnetic coil 71. The plunger end having the flange forcibly pulls the movable contactor 10 away from the fixed contact FC against the spring force acting on the arm 11 and, at the same time, the other end of the plunger pushes the engaging end of the tripping lever 64 to rotate the lever 64 and disengage the hook end of the lever from the ratch link 65. The excess current will flow also through the bimetal means 8 to generate heat and deform it and, due to the deformation, the free end of the bimetal means 8 pushes the arm of the tripping lever 64 to substantially simultaneously disengage the lever 64 from the ratch link 65. This disengaging operation allows the ratch link 65 to rotate, thereby the tripping link 66 is also moved, the closed state of the first link system is tripped, the arm 11 and movable contactor 10 are rotated by the spring force and the movable contact MC is forcibly separated from the fixed contact FC. In the case of such forcible tripping operation in response to the excess current, an arc is generated between the both contacts thus separated.

Figure 4:
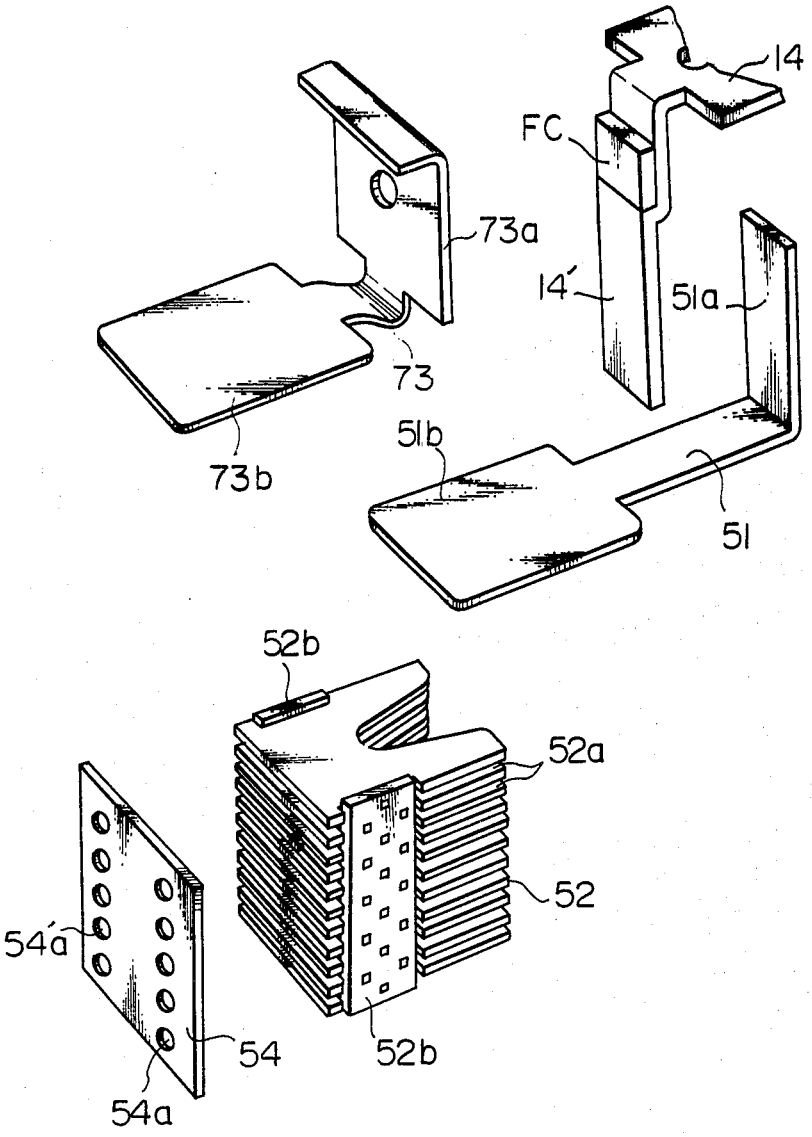
FIG. 4 is a perspective view showing component parts as disassembled of the arc suppressing means shown in FIGS. 2 and 3.

The arrangement of the arc suppressing means 5 shown in FIGS. 2 to 4 for suppressing such arc generated shall be described. According to this embodiment, first, the fixed contactor 14 is extended at the leg having the fixed contact FC substantially to the bottom wall of the arc suppressing chamber 4 along the end wall of the chamber as shown by 14', the both walls being in rectangular relation to each other. A fixed-contactor side arc-running plate 51 made by bending a conductive metal plate to be L-shaped is provided with a main part lying along a bottom surface of the chamber and a perpendicularly bent leg **51*a*. The leg 51*a* extends upwardly and is joined in the lengthwise direction to the extended leg 14' of the fixed contactor. An expanded portion 51*b* of the tip of the other leg is positioned on the bottom wall on the side of the load side terminal 9 in the arc suppressing chamber 4. A deion grid 52 placed on the expanded portion 51*b* comprises a stack of a plurality of conductive metal plates, which are respectively cut to be substantially V-shaped in the lengthwise direction from an end edge facing the fixed contactor and stacked substantially in parallel to face each other through a gap 52*a* as held between a pair of insulative plates 52*b*. On the uppermost one of these plates of the grid 52, an expanded portion 73*b* of an arc-running plate 78 is disposed. This portion is provided substantially at right angles to a base plate 73*a* of the movable-contactor side arc-running plate 73 and extends from the lower end of the conductive metal base plate 73*a* of the tripping mechanism 7. As the upper end of the base plate 73*a* is electrically connected to the movable contactor 10 as well as to the bimetal means 8 so as to act as a fixed end supporting member of the means 8, an occurrence of the short-circuiting current causes, on one hand, the fixed-contactor side arc-running plate 51 together with its expanded portion 51*b* which are electrically connected to the fixed contact FC and, on the other hand, the movable-contactor side arc-running plate 73 together with its expanded portion 73*b* to be of the same potential with each other. Between the extended leg 14' of the fixed contactor 14 and an end edge of the grid 52 opposing each other as vertically erected from the bottom wall of the arc suppressing chamber 4 through a distance defined by the fixed-contactor side arc-running plate 51 arranged along this bottom wall, there are disposed preferably, as seen in FIGS. 2 and 3, a pair of arc gas circulating plates 53 made of ceramics also as erected from the bottom wall along both side edges of the arc-running plate 51. Also preferably, a gas exhaust plate 54 made of an insulator is erected so as to vertically intersect the lengthwise direction of the arc suppressing chamber along the other end edge of the deion grid 52, that is, the end surface on the side farther from the both contacts FC and MC. The plate 54 has two rows of exhaust ports or slits 54***a* and 54*a'* communicating every other gap 52*a* of the grid with the interior space of the arc suppressing chamber on both sides of the longitudinal axis of the chamber. Each of these exhaust ports or slits 54*a* and 54*a'* is made to be of a size not exceeding the distance of each gap 52*a* in the erected direction from the bottom wall of the chamber. A guiding pillar 55 extending along the longitudinal axis of the arc suppressing chamber is provided between the exhaust plate 54 and an end wall of the arc suppressing chamber on the side of the load side terminal 9 so as to bring the exhaust plate 54 into close contact with the end edge of the grid 52. However, so long as this close contact relation is achieved, the guiding pillar may be omitted. A gas vent 56 is provided, in the present instance, in the end wall on the side of the terminal 9 of the arc suppressing chamber so that the gaps 52*a* of the grid will communicate with the atmosphere outside the means through the ports 54*a* and 54*a'* in the exhaust plate and vent 56. The upward opening above the deion grid 52 of the arc suppressing chamber 4 and vent 56 is closed preferably with an insulative plate 57 inserted particularly between the coil 71 and the movable-contactor side arc-running plate 73 and its expanded portion 73*b* so that the arc suppressing means 5 is partitioned from the respective mechanisms 6 and 7.

The operation of the arc suppressing means 5 of the present invention having the above arrangement shall be described in the followings. When, in the closed state of the both contacts FC and MC as in FIG. 2, the excess current at the terminal 9 from the load circuit causes the tripping mechanism 7 to be operated as has been described above and its plunger 72 disengages the tripping lever 64 of the contact operating mechanism 6 from the ratch link 65 together with the bimetal means 8 to forcibly trip the contact closing state of the mechanism 6. At this time, the plunger 72 of the mechanism 7 simultaneously quickly pulls the movable contact 10 with its flanged end in the direction in which the movable contact MC separates from the fixed contact FC so that the pulling force of the plunger 72 will be added to the force of the movable contactor biasing spring which is activated by the tripping operation of the mechanism 6, whereby the both contacts FC and MC will quickly separate from each other with a shortened opening time A (of about 1 m.sec). Following this opening, an arc will be generated between the both contacts as described above.

Upon the arc generation, a magnetic flux acting in the direction of the tips of both contactors is produced between separated contactors due to the excess short-circuiting current flowing through the contactors respectively in reverse directions, i.e. toward the movable contact side tip from the pivoting side in the movable contactor 10 and toward the current source side terminal 13 from the fixed contact side tip in the fixed contactor 14. This flux drives the arc toward the bottom wall of the arc suppressing chamber 4 in the present instance of FIG. 2. In this embodiment, as the fixed contactor 14 has the leg 14' extended substantially linearly to the bottom wall of the arc suppressing chamber from the fixed contact FC, the magnetic flux proportional to the ratio of the length of the opposed current paths to the distance between both current paths will be increased substantially to the maximum by this extended leg 14' which is rendering the length of the current path on the fixed contactor side shown by X in FIG. 2 to be maximum in the depth direction of the arc suppressing chamber 4. Therefore, the arc is quickly extended and increased along the extended leg 14' by this strong magnetic flux, whereby the staying time B of the arc is remarkably shortened and the arc voltage also quickly rises.

The arc gas produced simultaneously with the arc generation will be strongly ionized by the high arc voltage in the space from the position between the separated contacts to the bottom wall of the arc suppressing chamber, whereby magnetic fluxes are induced in directions in which the both contacts are separated, that is, toward and away from the opposing end edge of the grid 52 substantially over the length of the extended leg 14'. However, the flux in the direction toward the extended leg 14', i.e., away from the grid's end edge will be weakened by the presence of the end wall of the arc suppressing chamber and, as a result, the magnetic flux toward the opposing end edge of the deion grid 52 from the extended leg 14' will strongly drive the arc extended along the leg 14' virtually toward the deion grid 52. The thus extended arc that is driven toward the grid runs along the running plate 51 connected to the extended leg 14' through the vertically erected portion 51*a* and extending along the bottom wall of the arc suppressing chamber, then expands toward the movable-contactor side arc-running plate 73 extending above the arc suppressing chamber with the same potential as the running plate 51, quickly travels toward the grid's end edge between the both running plates 51 and 73 under a higher voltage and reaches the edge with a remarkably shortened arc traveling time.

The arc having thus reached the end edge of the grid 52 under the high voltage over the entire width between both running plates 51 and 72 will be divided into a plurality of small arcs which are drawn into the respective gaps, each under a substantially equally divided arc voltage of the high voltage depending on number of the gaps 52*a*, the thus divided arcs further run to the other end edge of the grid through the respective gaps and are extinguished at the other end edge, and only a resultant gas passes through the ports 54*a* and 54*a'* in the exhaust plate 54 and is exhausted out of the device through the vent 56.

While, in the drawings, the vertically erected leg portion 51*a* of the fixed-contactor side arc-running plate 51 in this embodiment is shown to be substantially of the same width as the fixed contactor's extended leg 14', the leg portion 51*a* may be made to have a width substantially equal to the width of the arc suppressing chamber 4, or the end wall of the arc suppressing chamber 4 may be covered with a separately prepared plate member made preferably of a metal, whereby an evaporation of fine particles of the insulative material forming the base 1 due to the ionized high temperature arc gas and a mixture of such particles as impurities into the arc gas from the end wall can be prevented and the magnetic driving force for the arc travel by the arc gas will act substantially at the maximum efficiency.

Figure 5:
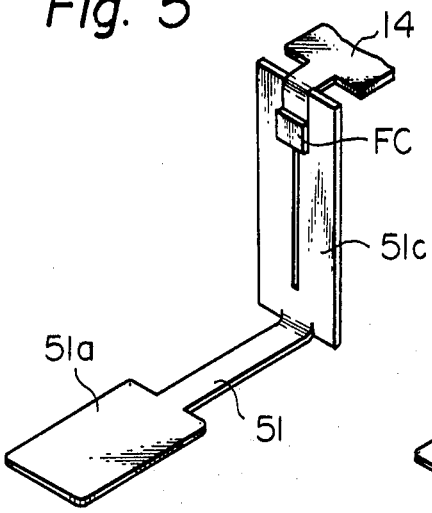
FIG. 5 is a perspective view showing a combined arrangement of an arc running plate and fixed contactor of the arc suppressing means according to another embodiment of the present invention.

In the embodiment shown in FIG. 5, the fixed contactor 14 is terminated at the fixed contact FC, whereas the arc running plate 51 is provided with an expanded upright leg portion 51*c* having an expanded width substantially equal to the width of the arc suppressing chamber 4 and having at the tip an incision or recess for receiving the bent portion of the fixed contactor 14 having the fixed contact FC. In the illustrated case, the expanded upright leg portion 51c is preferably provided with a longitudinal slit extending from the incision or recess to a position adjacent the bent portion continued to the running plate 51. Therefore, while the maximum length X of the excess short-circuiting current path on the fixed contactor side is maintained to be as in the case of the embodiment of FIGS. 2 to 4, the expanded upright leg portion 51c effectively prevents impurities from mixing into the arc gas from the end wall of the arc suppressing chamber 4. In addition, the longitudinal slit of the leg portion 51c accelerates the running of the arc along the opposed end edges defining the slit and is effectively contributive to the shortening of the arc staying time B and thus to the magnetic drive for the arc extension, arc voltage elevation and arc travel acceleration toward the grid.

Figure 6:
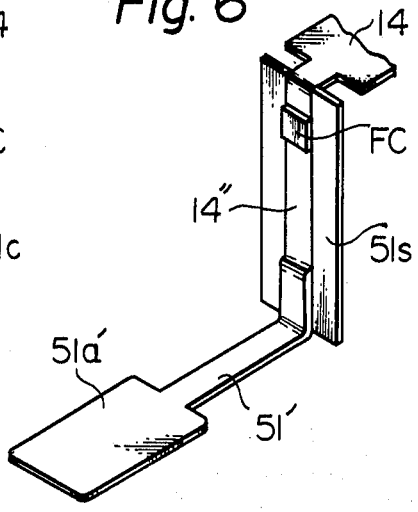
FIG. 6 is a perspective view showing another combined arrangement of the arc running plate, fixed contactor and additionally used arc drive promoting plate in another embodiment of the present invention.

FIG. 6 shows a still further embodiment of the fixed-contactor side arc-running plate. Here, the fixed contactor 14 has an extended leg 14'' extending beyond the fixed contact FC, which is further extended along the bottom wall of the arc suppressing chamber and forms an arc running plate 51' and its expanded portion 51a' integrally joined to the leg 14''. This extended leg 14'' is provided preferably with a stepped portion adjacent the junction with the running plate 51', the bottom portion of a separately prepared and substantially U-shaped shielding plate 51s having substantially the same width as the arc suppressing chamber and made of a metal is contacted with the stepped portion of the extended leg 14'' and both upright legs of the U-shaped shielding plate 51s are brought into contact with both sides of the fixed contact FC and extended leg 14''. Therefore, this embodiment can also operate substantially the same as in the case of the embodiment of FIG. 5.

FIG. 7 shows an example of a preferable arrangement of the exhaust plate 54. In the deion grid of the formation as in FIGS. 2 to 4, the respective incoming and divided arcs into the respective gaps 52a of the grid from its entrance side end edge are normally alternately deviated mutually in reverse directions with respect to the longitudinal axis of the grid, that is, vertically in FIG. 3, in the respective adjacent gaps. Therefore, the divided arcs will come running as shown in FIG. 7 toward the exhaust ports 54a or 54a' of the exhaust plate 54 provided in two rows on both sides of the longitudinal axis of the grid alternately in every other gap. If the thickness $l_2$ of the exhaust plate 54 in the drawing is insufficient, the distance along the surface of the plate connecting the two adjacent exhaust ports 54a or 54a' in each row will be so small that the two divided arcs reaching these two exhaust ports will be again bridged, the arc voltage will fluctuate, the linearity of the fall of the arc current will be lost and the current limiting effect will reduce. In order to effectively attain the current limiting effect, therefore, it is preferable to enlarge the thickness $l_2$ of the exhaust plate to keep the effective distance along the surface. As a result of experiments, it is found that, when the maximum distance of every other gap, that is, of three gaps, is $l_1$ and the maximum distance between the two adjacent exhaust ports in each row is $l_3$, $2l_2+l_3$ should be at least equal to or larger than $2l_1$, so that the divided arcs will be effectively prevented from being bridged again. In such case, it is not always necessary to employ a single exhaust plate of a desired thickness but a plurality of exhaust plates each of an insufficient thickness may be stacked. Such exhaust plate may even be provided as an integral part of the base 1.

In relation to the above described distance along the surface for preventing the divided arcs from being bridged again, there is shown in FIG. 8 an example of a preferable arrangement of the expanded portion of the arc running plate relative to the grid or to the exhaust plate. In this case, the expanded portion 51a or 51a' of the fixed-contactor side arc-running plate is disposed in a recess provided in the bottom wall of the arc suppressing chamber so as to oppose the expanded portion 73b of the movable-contactor side arc-running plate through a larger distance than that between the portion 73b and a bottom wall surface 4' on which the deion grid 52 and exhaust plate 54 are placed. Alternatively the deion grid and exhaust plate may be placed on a projection provided on the bottom wall. In either case, the distance along the bottom wall surface 4' between the respective end edges of the expanded portion 51a or 51a' and the grid 52 is made larger. Preferably, further, at least the end edge of the expanded portion 51a or 51a' of this fixed-contactor side arc-running plate is terminated at a position remote from the end edge of the grid or the exhaust plate so as to increase the distance along the surface between the both edges, and the opposed portions with the same potential of the both arc running plates are terminated at a position separated from the grid's terminating end edge so that the divided arcs may be positively suppressed at the terminating end. In such case, if the expanded portion 73b of the movable-contactor side arc-running plate is also terminated in the same manner as separated from the grid's terminating end edge, the effect of the arc suppression will be high.

Figure 1A:
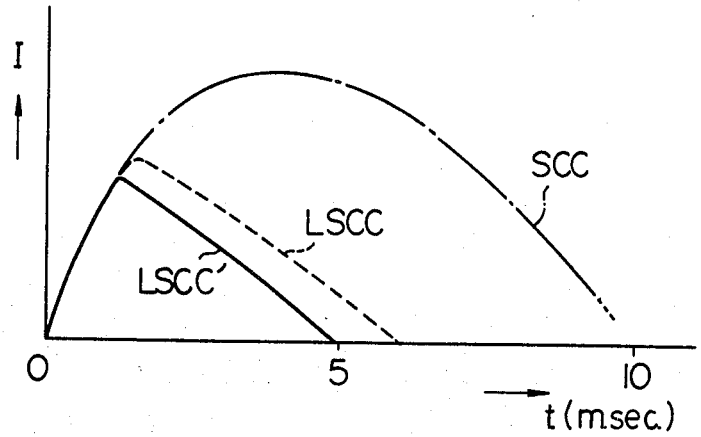
FIGS. 1A and 1B are diagrams for explaining the current limiting and arc suppressing effects of the arc suppressing means for current limiting circuit breakers according to the present invention in relation to the excess short-circuiting current and arc voltage shown respectively by a typically represented wave form.
Figure 1B:
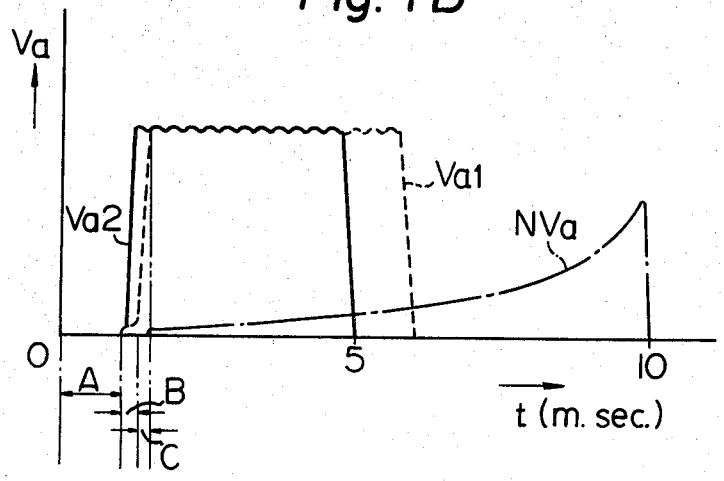

According to mean value of experimental data of the above described respective embodiments, it is found that, according to the present invention, the arc staying time B and traveling time C are remarkably shortened as in the arc voltage curve Va2 shown by a solid line in FIG. 1B and the sum of these times is about 1.2 m.sec., in contrast to the conventional time of about 1.5 m.sec. in the case where the fixed-contactor side excess current path length X is reduced in the right angle upright relation to the arc running plate as in the past. By this reduction of the arc staying and traveling time by about 0.3 m.sec., as shown by a solid line in FIG. 1A, the short-circuiting current LSCC' limited by the present invention reaches the zero point in about 6 m.sec. and, at the same time, the arc voltage becomes zero.

According to the present invention, in the arc suppressing means of the current limiting circuit breaker, as has been described, the length of the excess short-circuiting current path on the fixed contactor side in the substantially parallelly extended relation to the movable contactor is made to be maximum in the right angle relation to the arc running plate for running the arc generated between the movable and fixed contacts toward the entrance end edge of the gaps of the deion grid which is present to extend in the direction intersecting this current path substantially at right angles and also in the relation to the width in the grid's stacking direction of the entrance end edge of the desired deion grid, thereby the respective magnetic driving forces in the direction along the current path for the generated arc and further in the direction toward the deion grid along the arc running plate will be remarkably increased, the arc staying and traveling time after the opening of the both contacts will be effectively shortened and a high current limiting effect will be obtained.

The width of the member connected to the particular current path or forming the path to extend the arc down to the running plate is made substantially equal to the width of the fixed contactor side end wall surface of the arc suppressing chamber so that impurities of the base made of the insulative material and defining the arc suppressing chamber can be prevented from mixing into the arc gas from this end wall surface, the magnetic driving force for the arc in the direction along the arc running plate can be increased and, in particular, the effect of shortening the arc traveling time can be achieved. Further, in order to maintain the thus obtained high current limiting effect, the thickness of the exhaust plate arranged along the terminating end edge of the deion grid is so made that the maximum surface distance along the exhaust plate between the two exhaust ports corresponding to the two divided arcs which may possibly be bridged again can be at least equal to twice the maximum distance between the two divided arcs, so that the divided arcs can be positively prevented from being bridged again at the terminating end edge of the deion grid and the current limiting effect can be effectively shown. In this connection, at least the fixed contactor side one of the expanded portions of the arc running plate which has been conventionally forming one of the gaps as opposed to the outermost layer metal plate of the deion grid and extended to the grid's terminating end edge is now terminated as separated from the end edge and exhaust plate, and the arc suppressing chamber's bottom wall surface at the part from the position of the grid's end edge and exhaust plate to the terminating edge of the expanded portion of the arc running plate is made higher than the surface of this expanded portion so that the distance along the particular bottom wall surface between the terminating edge of the arc running plate and the terminating end edge of the grid will be so large that the divided arcs will be effectively prevented from being bridged again. Further, these effects can be attained substantially without requiring any additional part and, therefore, without substantially increasing manufacturing costs of the circuit breaker of the kind referred to.

What is claimed is:

1. An arc suppressing means for current limiting circuit breakers comprising a base made of an insulative material for mounting a circuit breaker; a movable contactor pivoted to be rockable at one end having a movable contact; means for manually operating said movable contactor; means electrically connecting a load side terminal to the movable contactor; means for tripping a contact closing position of the movable contactor in response to an excess short-circuiting current; an arc suppressing chamber provided in said base so as to receive adjacent an end wall thereof at least said rockable end of the movable contactor; a fixed contactor mounted to the base and including a part having a fixed contact positioned to contact with said movable contact in said contact closing position adjacent said one end wall of said arc suppressing chamber, said part of said fixed contactor extending substantially in a direction parallel to the movable contactor along the one end wall of the arc suppressing chamber; a first arc running plate extended along a surface of the arc suppressing chamber which is perpendicular to said one end wall surface of the chamber and including means for electrically connecting said first arc running plate to said extended part of the fixed contactor; a second arc running plate disposed substantially in parallel to said first arc running plate and electrically connected to the movable contactor; and a deion grid disposed between said first and second arc running plates and arranged within the arc suppressing chamber with entrance ends of respective gaps directed to the one end wall of the arc suppressing chamber and with terminating the ends directed to the other end wall of the chamber, wherein said first arc running plate has a beginning end at said one end wall of the arc suppressing chamber, and said means for electrically connecting the first arc running plate to the fixed contactor is connected to said beginning end of the first arc running plate perpendicular to the first arc running plate and in substantially parallel relation to the movable contactor, said movable contact engaging said fixed contact adjacent the end of said connecting means that is remote from said beginning end of said first arc running plate to thereby render an excess short-circuiting current path on the side of the fixed contactor to be substantially maximum.

2. An arc suppressing means according to claim 1 wherein said electrical connecting means comprises a vertically erected part of said first arc running plate extending along said one end wall of said arc suppressing chamber from said beginning end of the first arc running plate and joined with said part having the fixed contact of said fixed contactor.

3. An arc suppressing means according to claim 2 wherein said part having the fixed contact of said fixed contactor includes a part extending from the position having the fixed contact substantially to a position adjacent said surface perpendicular to said one end wall of the arc suppressing chamber and connected to said erected part of said first arc running plate.

4. An arc suppressing means according to claim 3 wherein said erected part of said first arc running plate covers said one end wall of said arc suppressing chamber.

5. An arc suppressing means according to claim 3 wherein said erected part of said first arc running plate is integral with the first arc running plate and has a slit extending in the vertical direction from a position connected to said part having the fixed contact of said fixed contactor to a position adjacent an integral connection of the erected part to the first arc running plate.

6. An arc suppressing means according to claim 1 wherein said electrical connecting means comprises an extension of said part having the fixed contact of said fixed contactor, said extension extending along said one end wall of said arc suppressing chamber to said surface that is perpendicular to the one end wall of the chamber and being integrally joined to said beginning end of said first arc running plate.

7. An arc suppressing means according to claim 6 wherein said electrical connecting means further comprises a plate member which is connected to said extension on both sides thereof and having a shape and size of covering said one end wall of said arc suppressing chamber.

8. An arc suppressing means according to claim 1 which further comprises a gas exhausting member of an insulative material having a plurality of gas passing openings and disposed in said arc suppressing chamber to be in contact with terminating end of said deion grid, and a gas vent provided at said the other end of the arc suppressing chamber, said gas passing openings of said gas exhaust plate being provided in two rows separated from each other on both sides of the arc running direction of said deion grid, the respective openings in each row being respectively disposed adjacent every other gap of the deion grid, and the thickness of the exhaust plate being such that the maximum distance from the side on which the exhaust plate contacts said terminating end of the grid to the other side of the plate, summed with the distance between two adjacent openings of the respective rows, is at least twice the maximum distance between three gaps of the deion grid.

9. An arc suppressing means according to claim 1 wherein said surface that is perpendicular to said one end wall of said arc suppressing chamber has a stepped portion providing a height difference equal at least to the thickness of said first arc running plate between a part along which the first arc running plate extends and a part at which the terminating end of the deion grid is positioned, and said stepped portion abuts the terminating end of the first arc running plate.

10. An arc suppressing means according to claim 9 wherein at least said terminating end of said first arc running plate and said stepped portion of said arc suppressing chamber are separate from the terminating end of said deion grid on the side opposing the grid.

* * * * *